United States Patent [19]

Tyrseck

[11] 3,941,302

[45] Mar. 2, 1976

[54] AUTO PARTITION PACK WITH HANDLES

[75] Inventor: Walter J. Tyrseck, Quaker Hill, Conn.

[73] Assignee: Robertson Paper Box Co., Inc., Montville, Conn.

[22] Filed: June 9, 1975

[21] Appl. No.: 585,397

[52] U.S. Cl. ..... 229/27; 229/15; 229/41 B

[51] Int. Cl.[2] ..... B65D 5/48

[58] Field of Search ..... 229/27, 28, 15, 41 R, 41 B

[56] References Cited

UNITED STATES PATENTS

| | | | |
|---|---|---|---|
| 2,785,844 | 3/1957 | Metzger | 229/28 R |
| 2,880,921 | 4/1959 | Persson | 229/28 R |
| 2,909,311 | 10/1959 | Levitt | 229/28 R |
| 3,006,529 | 10/1961 | Richardson | 229/28 R |
| 3,118,589 | 1/1964 | Hughes | 229/27 |
| 3,145,903 | 8/1964 | Franklin | 229/27 |
| 3,184,141 | 5/1965 | Vrana | 229/28 |
| 3,184,143 | 5/1965 | Kotowick | 229/41 B X |
| 3,836,065 | 9/1974 | Hackenberg | 229/15 |

*Primary Examiner*—Davis T. Moorhead
*Attorney, Agent, or Firm*—Cesari and McKenna

[57] ABSTRACT

A box made from a single cardboard blank has a lock bottom and partitions to isolate articles in the box. Foldup tabs are provided to facilitate removing the box from a carton packed with such boxes.

10 Claims, 8 Drawing Figures

AUTO PARTITION PACK WITH HANDLES

BACKGROUND OF THE INVENTION

This invention relates to a partitioned box. It relates more particularly to a box of this type with a lock bottom made from a single cardboard blank and which is capable of being knocked down flat for storage.

Partitioned boxes are used to contain fragile or decorative articles such as ampules, vials, perfume bottles, etc. The partitions divide the box into a number of compartments, each containing a single article. Thus, the partitions protect the articles from contacting one another during shipment.

To minimize manufacturing costs, it is desirable that such boxes be made of a single blank of material and to minimize handling costs, it is preferable that the boxes be of the knockdown type with a lock bottom so that they can be stored in a minimum amount of space and be erected and filled quickly. Such partitioned boxes are shown in U.S. Pat. Nos. 2,785,844 and 2,880,921, the latter patent showing a box of the same basic type as the applicant's.

Prior folding partitioned boxes are disadvantaged because all of their partitions cannot extend the full height of the box. There is a gap in a wall or walls either at the top or bottom of the box, or at both these locations. Consequently, the tops and bottoms of articles on opposite sides of one of these short partitions can still contact one another, and be disfigured or damaged.

The reason that the partitions cannot extend the full heights of the prior boxes stems from the fact that, when erecting the boxes, certain partitions must automatically project through vertical slots in other partitions. Thus, with prior constructions if the latter partitions extend the full height of the box, the former partitions must be shorter than that. Attempts to solve this problem have, in the past, produced boxes with relatively weak partitions which tear when the box is erected or handled roughly or boxes which are difficult to set up because the partitions do not automatically project into the proper slots when the box sides are squared up.

It is a fact also that partitioned boxes of this general type with their contents are often shipped in large cartons with each carton containing a dozen or more filled boxes. Sometimes these boxes are packed tightly without top cover panels so that when the carton is opened, it is rather difficult to remove the boxes from the carton because there is no convenient way to grasp the box It would be convenient, therefore, if some means were provided on boxes of this type to facilitate their extrication from such larger cartons.

SUMMARY OF THE INVENTION

Accordingly, it is an object of the present invention to provide a partitioned box which gives maximum protection to the box contents.

A further object of the invention is to provide a partitioned box which is relatively inexpensive to make and easily erected.

Still another object of the invention is to provide a lock bottom partitioned box all of whose partitions can extend all the way to the bottom and/or top of the box.

A further object of the invention is to provide a box of that type made from a single cardboard blank.

Yet another object of the invention is to provide a partitioned box with accessible carrying handles.

Another object of the invention is to provide a blank for making a box having one or more of the above characteristics.

Other objects will in part be obvious and will in part appear hereinafter.

The invention accordingly comprises the features of construction, combination of elements and arrangement of parts which will be exemplified in the following detailed description and the scope of the invention will be indicated in the claims.

Briefly, the present partitioned box has the usual front, rear and two side wall panels hinged to form a tube. The bottom of the box comprises a pair of trapezoidal panels whose bases are hinged to the lower edges of the front and rear wall panels and a pair of generally rectangular panels hinged to the lower edges of the side wall panels. When the box is fully erected, these four panels interfit to completely close the bottom of the box.

The subject box has a single longitudinal partition which may extend the full height of the box and a pair of transverse partitions which also may extend the full height of the box to divide the box into six compartments.

The transverse partitions comprise a pair of rectangular panels hinged to the free edges of the rectangular bottom panels parallel to their hinged connections to the side wall panels. Each of the transverse partition panels has a relatively large tab hinged to its free upper end so that it projects up from the panel.

Also, each transverse partition panel is formed with a slot usually extending its entire length. Furthermore, the slot also extends partially through the tab and partially through the rectangular bottom panel connected to that partition panel. The portion of the slot in the adjacent bottom panel is generally triangular in shape with an edge that is substantially parallel to the side edge of the nearest trapezoidal bottom panel.

The longitudinal partition in the box consists of a pair of rectangular panels hinged to the edges of the trapezoidal bottom panels parallel to their bases. Each of these rectangular panels may extend away from its hinge a distance equal to the full height of the box. Further each such panel has a hinged connection to one of the transverse partition panels and projects through the slot in the other transverse partition panel so that the two longitudinal partition panels lie flush against one another.

When the box is erected by squaring up its wall panels, the longitudinal partition panels engage in the slots in the adjacent transverse partition panels. As the box assumes its shape, the partition panels drive the bottom panels downwards where they interfit in a common plane closing the bottom of the box. In the process, the triangular-shaped bottom ends of the slots in the bottom panels slidabley receive the bottom edges of the longitudinal partition panels to provide clearance as the bottom panels swing down into place. At the same time, the top edges of those longitudinal partition panels are slidably received in the upper ends of the slots at the tabs. Thus when the box is fully erected, those longitudinal partition panels can extend the full height of the box. Still, they are securely retained in place by the tabs which bridge the slots in the transverse panels.

Of course, the box may also include the usual cover flaps. When these flaps are folded down in place, the hinged tabs automatically fold down out of the way against the tops of the partitions. In some applications, a gap may be tolerated between the longitudinal partition portions and the bottom of the box. In this event, the slots can terminate short of the adjacent bottom panels and the bottom edges of the longitudinal partition panels can be sharply rounded or cut back so that they can be received in these slots. Likewise if the longitudinal partition panels can terminate short of the top of the box in a given case, the slots can be shortened correspondingly and the tabs eliminated. Usually however, full height partitions are preferred.

After the box is filled, it can be lifted from a carton and transported by grasping the tabs projecting up from the transverse partitions. The tabs are connected through the partitions directly to the parts of bottom panels at the middle of the box which bear most of the weight of the box contents. Accordingly, the filled box can be carried about with little danger of articles falling through the bottom of the box, which may not be the case if the box is lifted by its side walls.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
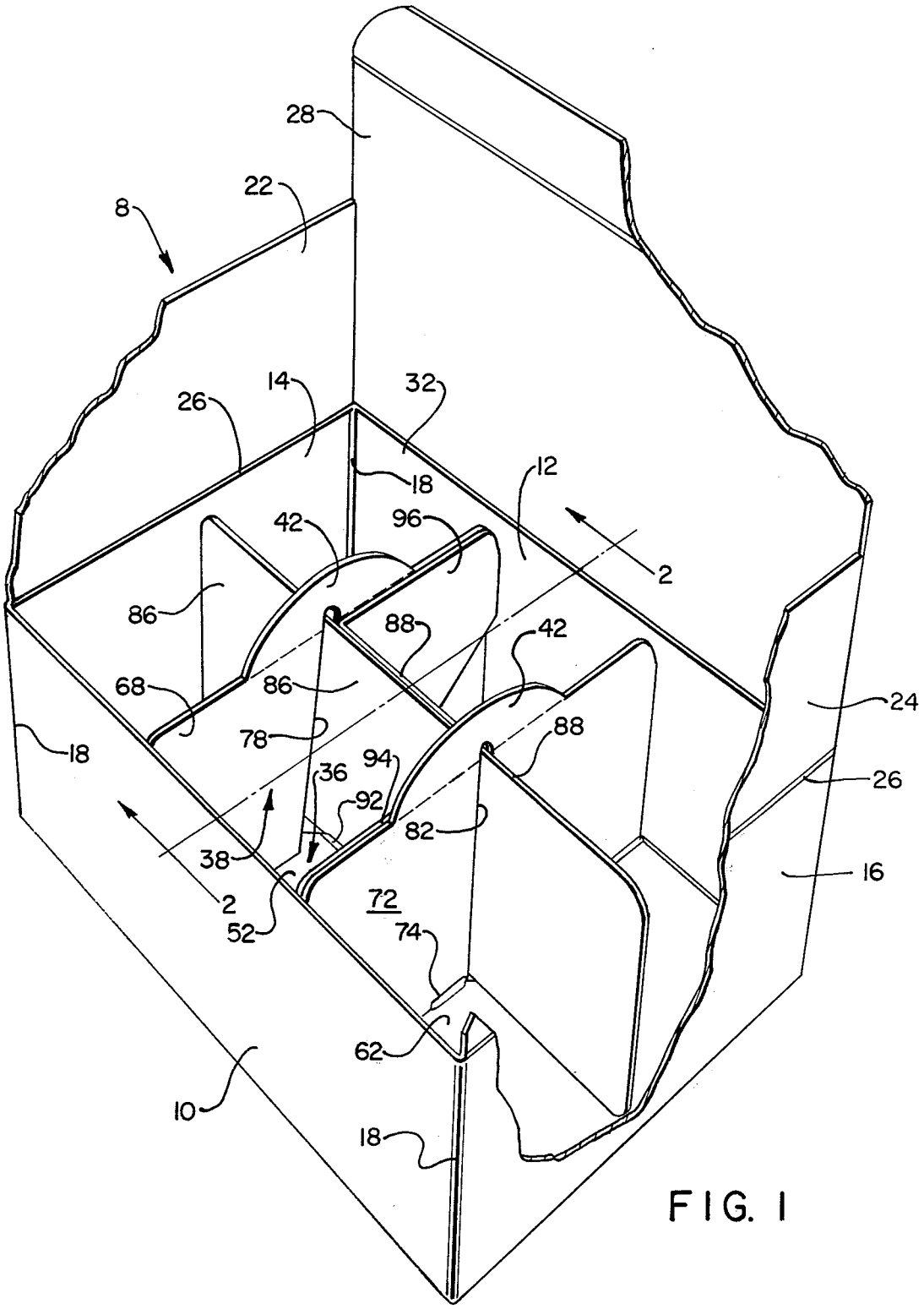
FIG. 1 is a perspective view from above with parts broken away showing a partitioned box made in accordance with this invention.
Figure 2:
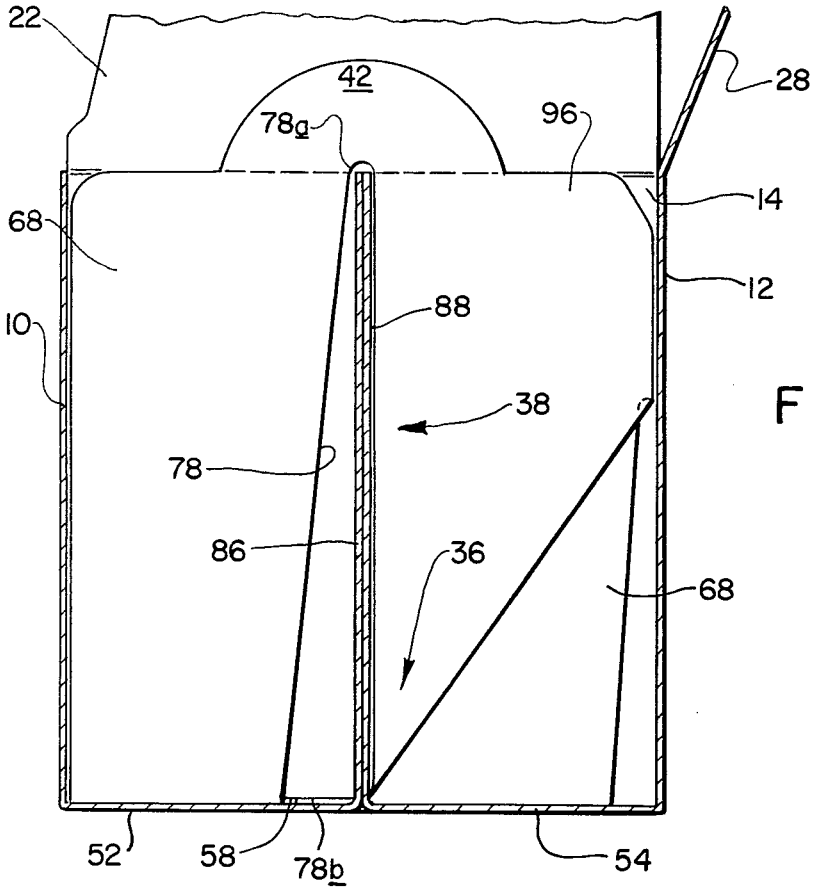
FIG. 2 is a sectional view along line 2—2 of FIG. 1.

Turning now to FIG. 1 of the drawings, a box 8 made in accordance with this invention includes a front panel 10, a rear panel 12 and a pair of side panels 14 and 16, with adjacent panels being connected along fold lines 18. The box has the usual auxiliary cover flaps 22 and 24 connected along hinge lines 26 to the top edges of the side panels 14 and 16, respectively. Also, a main cover flap 28 is hinged at fold line 32 to rear panel 12.

The bottom of box 8 is closed by a bottom assembly shown generally at 36 and the box itself is divided into six compartments by a partition assembly 38. In the usual case, assembly 38 extends the full height of the box so that it completely isolates an article in one compartment from articles in adjacent compartments.

Figure 8:
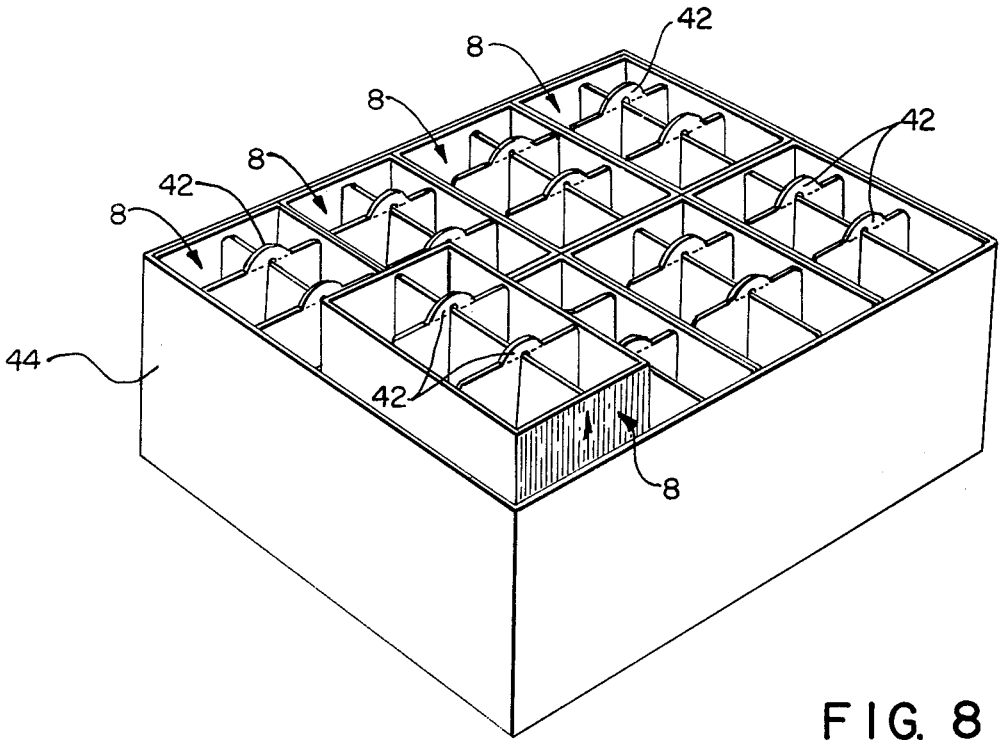
FIG. 8 is a perspective view on a smaller scale showing several FIG. 1 boxes packed in a carton.

A pair of handles in the form of large tabs 42 integral with partition assembly 38 project up from the top of the open box to facilitate extricating box 8 from a carton such as the one shown at 44 in FIG. 8 and carrying the box from one place to another.

Figure 4:
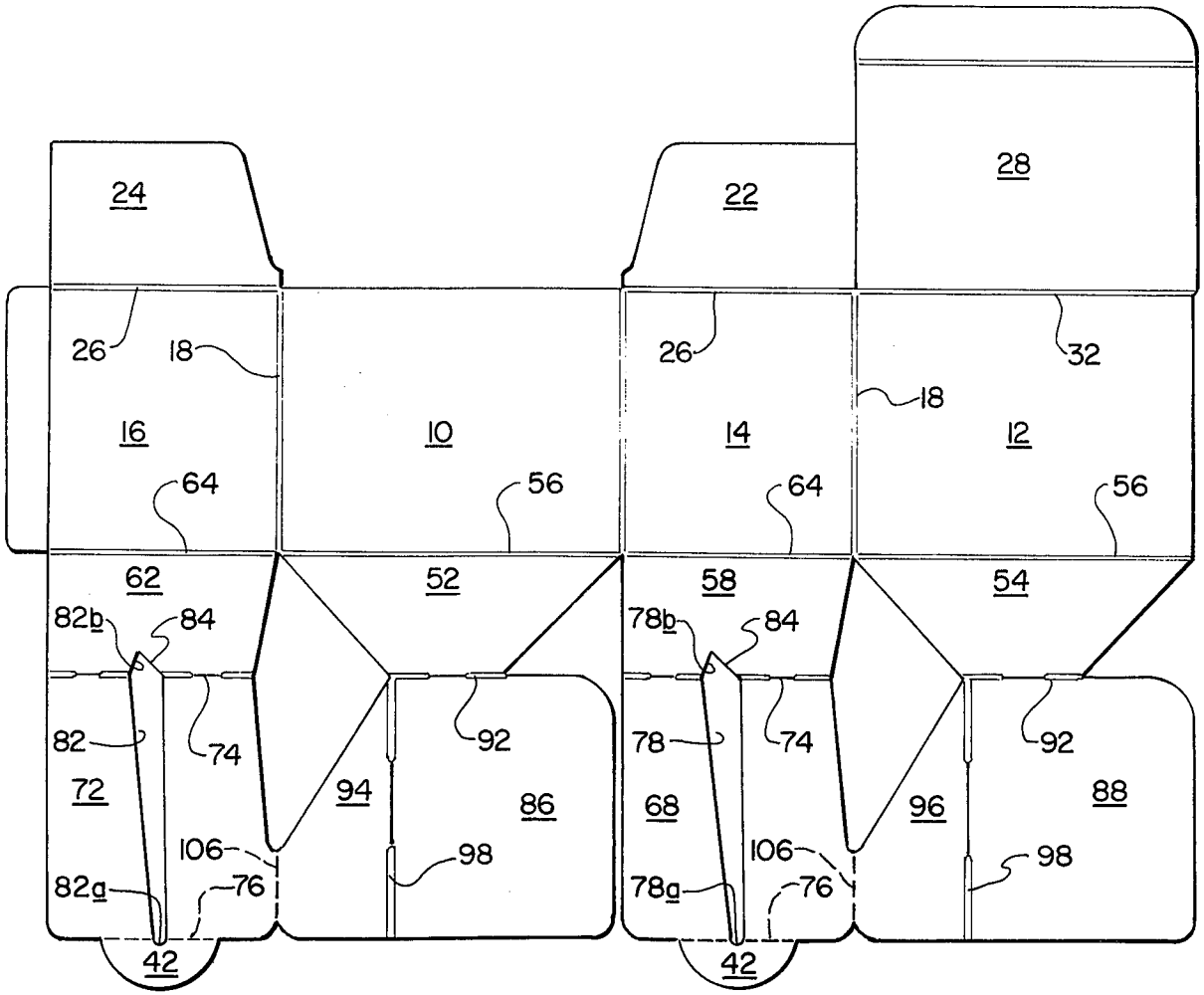
FIG. 4 is a top plan view of the blank from which the FIG. 1 box is made.

Referring now to FIGS. 1 and 4, bottom assembly 36 comprises a pair of trapezoidal bottom panels 52 and 54 having their bases hinged at 56 to the bottom edges of the front and rear panels 10 and 12 respectively. Each panel 52, 54 extends the full width of the box and one-half its depth. Assembly 36 also includes a pair of generally rectangular panels 58 and 62 hinged at 64 to the bottom edges of the side panels 14 and 16, respectively.

Panels 58 and 62 extend the full depth of the box and their height is approximately one-third the length of the box. When the box is fully erected as shown in FIG. 1, the bottom wall panels 52, 54, 58 and 62 interfit to completely close the bottom of the box and support the box contents.

Partition assembly 38 is integral with the bottom assembly 36 and includes a pair of transverse partition panels 68 and 72 hinged at 74 to the edges of the rectangular bottom panels 58 and 62 respectively parallel to hinges 64. The panels 68 and 72 extend from those hinges a distance substantially equal to the height of box panels 10, 12, 14 and 16 and their width is approximately equal to the width of side panels 14 and 16. The tabs 42 are hinged at 76 to the edges of panels 68 and 72 parallel to hinges 74.

As best seen in FIGS. 1 to 4, the transverse panels 68 and 72 are formed with elongated diverging slots 78 and 82 respectively, each slot having a relatively narrow end portion **78*a*, 82*a* extending beyond hinge 76, partially through the adjacent tab 42. The slots gradually widen and terminate in triangular portions 78*b*, 82*b* which project beyond hinges 74 into the adjacent bottom panels 58 and 62 respectively. Slot portions 78*b* and 82*b* are generally wedge-shaped or triangular and each has a side edge 84 which is oriented so that when the box is fully erected, edge 84 lies parallel to and abuts the adjacent side edge of the closest trapezoidal bottom panel 52, 54**.

Still referring to FIGS. 1 to 4, partition assembly 38 also includes a pair of rectangular longitudinal partition panels 86 and 88 hinged at 92 to the edges of trapezoidal bottom panels 52 and 54 parallel to their hinges 56. The width of each panel 86, 88 is approximately equal to two-thirds the length of front and rear walls 10 and 12. Furthermore, these panels extend from hinges 92 a distance substantially equal to the height of the panels 10, 12, 14 and 16 so that they, along with the transverse partition panels, divide the box into six compartments which extend the full height of the box.

The longitudinal partition panels 86 and 88 have side extensions 94 and 96 respectively hinged at 98 which lie flush against and are adhered to the adjacent face of transverse partition panels 72 and 68 respectively.

Figure 3:
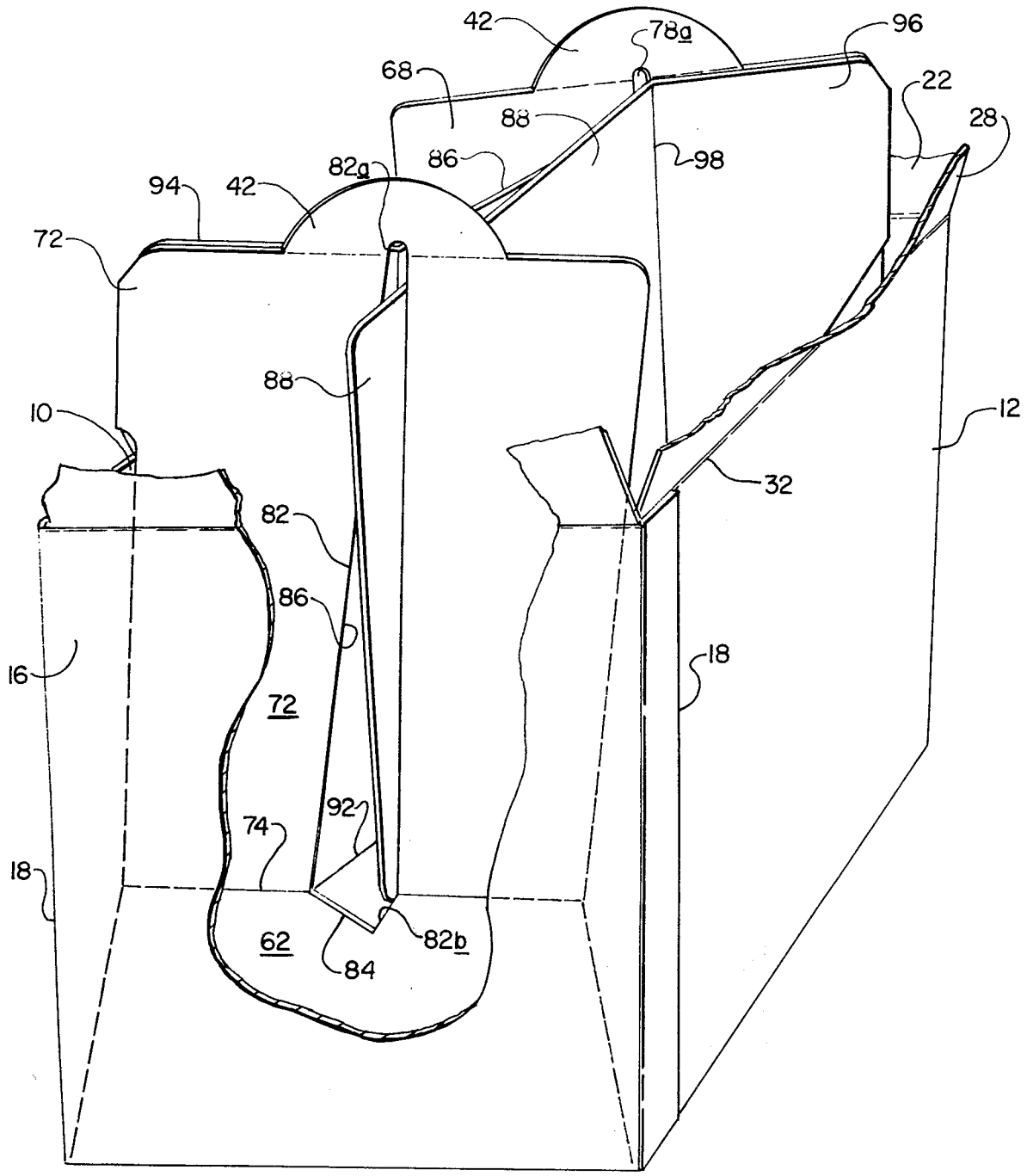
FIG. 3 is perspective view of the FIG. 1 box with parts broken away showing the box only partially erected.

Referring now to FIG. 3, as the box is squared up, the longitudinal partition panels 86 and 88 slide along each other so that their ends are guided into the slots in the transverse partition panels. The wedge-shaped slot portions **78*b* and 82*b* extending into the adjacent bottom panels 58 and 62 respectively provide clearance for the lower edges of the longitudinal partition panels as those bottom panels swing down into place. If slot portions 78*b* and 82*b*** were not present, the longitudinal partition panel portions in the end compartments of the box could not extend all the way to the bottom of the box.

Likewise, the slot portions **78*a* and 82*a* extending to the tabs 42 accommodate the top edges of the longitudinal partition panels with the tabs bridging the panels 86 and 88, and firmly retaining them. In the absence of tabs 42**, the longitudinal partition panels could not extend the full height of the box and be adequately secured.

As the box assumes its fully erect condition, the edges 84 of slot portions **78*b* and 82*b*** draw parallel to and abut the side edges of the adjacent trapezoidal bottom panels so that there are essentially no holes or gaps in the bottom of the box.

As noted above, in addition to strengthening the tops of the transverse partitions and providing clearance for the longitudinal partition panels during setup, the tabs 42 can function as handles to facilitate lifting the box and its contents from a carton 44 (FIG. 8) or to facilitate moving the box from place to place, particularly if the box is used without its cover flaps as a dispenser type of box.

Referring now to FIGS. 4 to 7, the box is formed from the single blank illustrated in FIG. 4, the various panels, flaps and hinge lines bearing the same identifying numerals that were given them in connection with the drawing figures discussed previously. A glue flap 102 hinged to the free side edge of side panel 16 is arranged to be glued to the free side edge of rear panel 12 to maintain the box in its tubular form.

Figure 5:
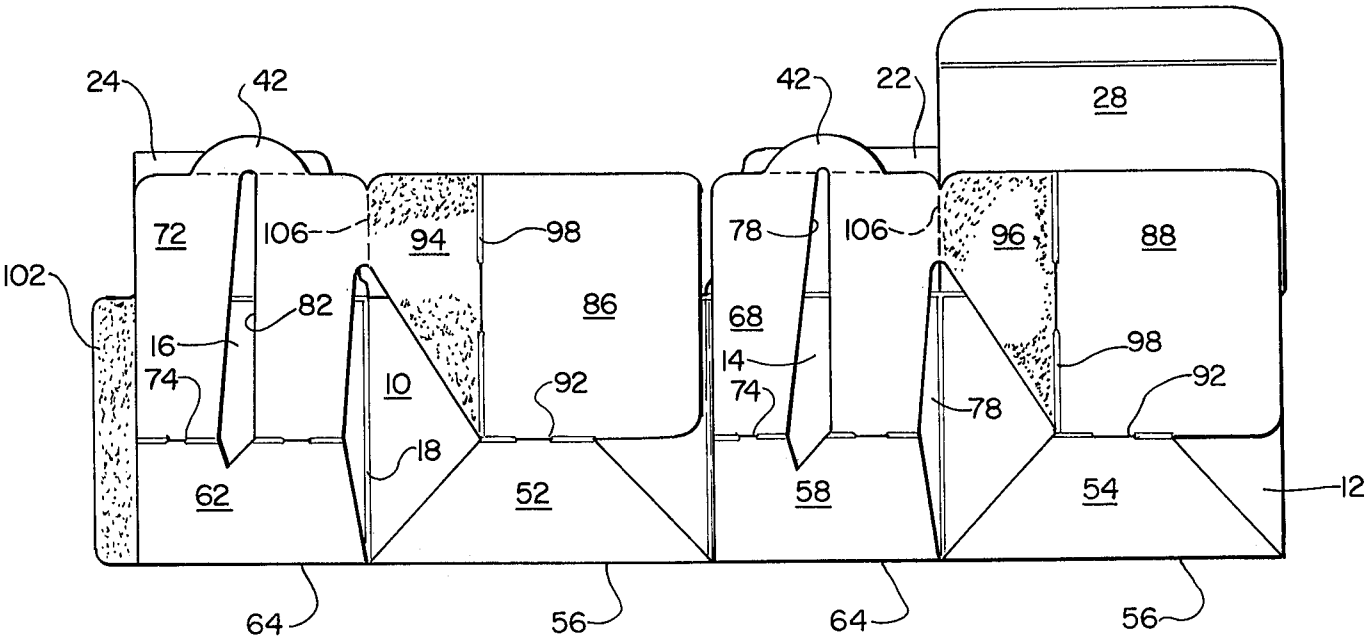
FIGS. 5 to 7 are similar views of the blank after successive folds.
Figure 6:
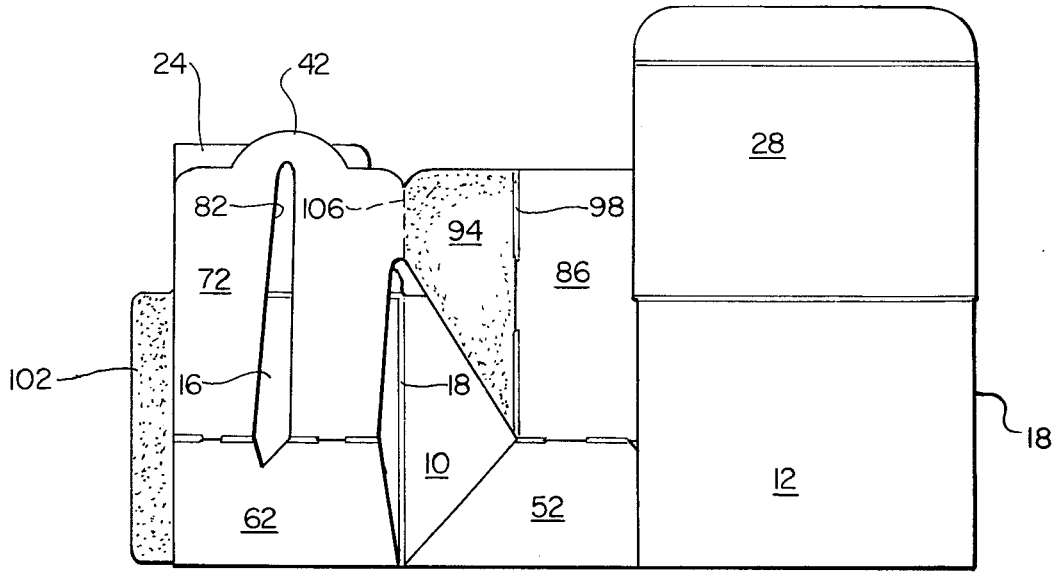

To form the box from the FIG. 4 blank, the partition and bottom panels are folded back flush against the front, rear and side panels as illustrated in FIG. 5. To help prevent the partition panels from flopping about during the folding operation, the panel extensions 94 and 96 can be hingedly connected to the adjacent side edges of the transverse partition panels 72 and 68 as indicated by the perforated fold lines 106 in FIGS. 4 and 5.

Next, glue is applied to the exposed surfaces of the panel extensions 94 and 96 and to the glue flap 102 as illustrated by the stippling in FIG. 5. Then rear panel 12 is folded at its hinge 18 onto the adjacent panel 14, so that panel extension 96 becomes adhered to the underlying area of transverse partition 68.

Figure 7:
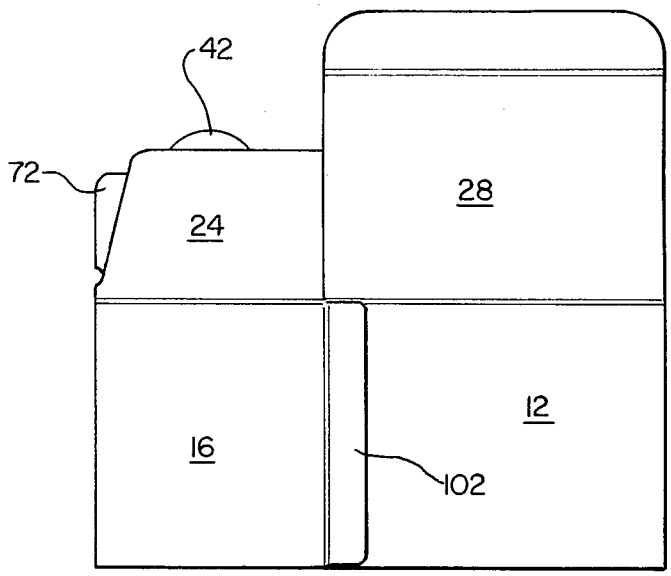

Finally, side panel 16 is folded at its hinge line 18 onto panel 10 so that panel extension 94 becomes adhered to the overlying portion of the transverse partition 72 with glue flap 102 adhering to the free side edge of rear panel 12 as shown in FIG. 7, thereby completing the box.

Of course if it is desired that the glue flap 102 be inside the box, glue is applied to the free edge of panel 12 instead of to glue flap 102 and then panel 16 is folded before panel 12.

The box is erected from its flat condition simply by pressing together the opposite side edges of the flattened box shown in FIG. 7. This action will automatically cause the box to square up and, in the process, the various bottom panels and partition panels will automatically assume their positions shown in FIG. 1, as described above.

It will be seen from the foregoing, then, that the provision of means for extending the heights of the slots in the transverse partitions in boxes of this type permits the use of longitudinal partition panels which extend the full height of the box. In addition, this construction provides the ancillary advantage of convenient fold-down handles which can be used to lift and transport the box and its contents. Yet these benefits are attained without any material sacrifice in box strength or increase in the cost of making the box.

Of course it should be understood that the subject box could be arranged with a pair of longitudinal partitions and a single transverse partition simply by reversing the locations of the longitudinal and transverse partition panels in the FIG. 4 blank.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings be interpreted as illustrative and not in a limiting sense.

It is also intended that the following claims are intended to cover all of the generic and specific features of the invention herein described.

I claim:

1. A partitioned box comprising

A. first and second pairs of parallel wall panels hinged together to form a tube, B. a first pair of similar bottom panels hinged to the bottom edges of the first pair of wall panels, C. a second pair of similar bottom panels hinged to the bottom edges of the second pair of wall panels, said two pairs of bottom panels interfitting to completely close the bottom of the box, D. a first pair of similar partition panels hinged to the edges of the first pair of bottom panels parallel to their hinges with the wall panels, E. a second pair of partition panels hinged to the edges of the second pair of bottom panels parallel to their hinges with the wall panels, F. means for hingedly connecting a side edge of one partition panel in the second pair to one partition panel in the first pair, G. means for hingedly connecting a side edge of the other partition panel in the second pair to the other partition panel in the first pair, H. a substantially vertical slot in each first pair partition panel for receiving an opposing second pair partition panel, said slot extending all the way to the top of said partition panel, and I. a relatively large tab hinged to the upper edge of each first pair partition panel for bridging the slot therein to retain the second pair partition panel within said slot, said tabs being accessible to function as carrying handles for the box and being foldable down against the tops of the partition panels when a cover is placed on the box.

2. The box defined in claim 1

A. wherein said slots extend all the way to the bottoms of said first pair partition panels and B. further including means defining openings in the first pair of bottom panels, said openings being contiguous with the slots in the adjacent first pair partition panels, said openings being arranged to accommodate lower edge portions of the second pair partition panels in said slots when the first pair of bottom panels fold down into place as the box is being erected.

3. The box defined in claim 2 and further including cover flaps hinged to the upper edges of the wall panels, said flaps being foldable to close the top of the box.

4. The box defined in claim 2 wherein each said opening

A. is generally triangular in shape, and

B. has one edge generally parallel to an edge of one of the second pair of bottom panels.

5. A partitioned box comprising

A. first and second pairs of parallel wall panels hinged together to form a tube, B. a first pair of similar bottom panels hinged to the bottom edges of the first pair of wall panels, C. a second pair of similar bottom panels hinged to the bottom edges of the second pair of wall panels, said two pairs of bottom panels interfitting to completely close the bottom of the box, D. a first pair of similar partition panels hinged to the edges of the first pair of bottom panels parallel to their hinges with the wall panels, E. a second pair of partition panels hinged to the edges of the second pair of bottom panels parallel to their hinges with the wall panels, F. means for hingedly connecting a side edge of one partition panel in the second pair to one partition panel in the first pair, G. means for hingedly connecting a side edge of the other partition panel in the second pair to the other partition panel in the first pair, H. a substantially vertical slot in each first pair partition panel for receiving an opposing second pair partition panel, said slot extending all the way to the bottom of said partition panel, and I. further including means defining openings in the first pair of bottom panels, said openings being contiguous with the slots in the adjacent first pair partition panels, said openings being arranged to accommodate lower edge portions of the second pair partition panels in said slots when the first pair of bottom panels fold down into place as the box is being erected.

6. The box defined in claim 5 wherein each said opening

A. is generally triangular in shape, and

B. has one edge generally parallel to an edge of one of the second pair of bottom panels.

7. The box defined in claim 5 and further including handles hingedly connected to the upper edges of the partition panels to facilitate lifting the box and its contents.

8. A blank for forming a lock bottom partitioned box comprising

A. a series of four hinged together wall panels, alternate ones of said panels of being substantially identical, B. a first pair of substantially similar bottom panels hingedly connected to the bottom edges of alternate ones of said wall panels, C. a second pair of substantially similar bottom panels, hingedly connected to the bottom edges of the remaining wall panels in the series, D. a pair of transverse partition panels hinged to the edges of the first pair of bottom panels parallel to their hinged connections with the wall panels, E. an elongated slot in each transverse partition panel said slot extending from the hinge between that panel and the bottom panel in a direction substantially perpendicular to that hinge for an appreciable distance along the transverse partition panel, F. a slit in each first pair bottom panel, each said slit being parallel and contiguous to the slot in the transverse partition panel hinged to that bottom panel, and G. a pair of longitudinal partition panels hinged to the edges of the bottom panels in a second pair parallel to their hinged connections with the wall panels, said longitudinal partition panels extending from said hinges for a distance slightly less than the length of said slots.

9. The blank defined in claim 8 and further including

A. auxiliary cover flaps hinged to the upper edges of alternate wall panels in the series, and B. a main cover flap hinged to the top edge of a third wall panel.

10. The blank defined in claim 8

A. wherein each said slot extends all the way from said hinge to the opposite edge of said transverse partition panel, and B. further including a tab hinged to said opposite edge of each transverse partition panel, said tab bridging the end of the slot through that said transverse partition panel.

* * * * *